US011279000B2

(12) United States Patent
Kawana et al.

(10) Patent No.: US 11,279,000 B2
(45) Date of Patent: Mar. 22, 2022

(54) POLISHING APPARATUS

(71) Applicant: DISCO CORPORATION, Tokyo (JP)

(72) Inventors: Mamoru Kawana, Tokyo (JP); Satoshi Yamanaka, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 612 days.

(21) Appl. No.: 16/371,326

(22) Filed: Apr. 1, 2019

(65) Prior Publication Data

US 2019/0308296 A1 Oct. 10, 2019

(30) Foreign Application Priority Data

Apr. 5, 2018 (JP) ..... JP2018-073222

(51) Int. Cl.

| | |
|---|---|
| ***B24B 37/34*** | (2012.01) |
| ***B24B 57/02*** | (2006.01) |
| ***B24B 37/10*** | (2012.01) |
| ***B24B 37/04*** | (2012.01) |

(52) U.S. Cl.

CPC ..... *B24B 37/34* (2013.01); *B24B 37/044* (2013.01); *B24B 37/107* (2013.01); *B24B 57/02* (2013.01)

(58) Field of Classification Search

CPC ..... B24B 37/044; B24B 37/34; B24B 37/107; B24B 57/00; B24B 57/02; B24B 57/04

USPC .... 451/36, 37, 54, 59, 41, 60, 67, 285, 287, 451/446

See application file for complete search history.

(56) References Cited

U.S. PATENT DOCUMENTS

| | | | | |
|---|---|---|---|---|
| 5,582,540 | A * | 12/1996 | Su | B24B 37/16 451/259 |
| 6,461,222 | B1 * | 10/2002 | Sato | B24B 37/042 451/287 |
| 6,939,204 | B2 * | 9/2005 | Moriya | B24B 37/345 451/36 |
| 7,059,948 | B2 * | 6/2006 | Li | B23H 5/08 451/287 |
| 7,108,589 | B2 * | 9/2006 | Kimura | B24B 9/065 451/246 |
| 7,335,090 | B2 * | 2/2008 | Takahashi | B24B 37/345 414/937 |
| 8,524,035 | B2 * | 9/2013 | Eisenstock | B24B 41/047 156/345.12 |
| 10,343,248 | B2 * | 7/2019 | Miyamoto | B24B 57/00 |
| 10,562,150 | B2 * | 2/2020 | Yamanaka | H01L 21/30625 |

(Continued)

FOREIGN PATENT DOCUMENTS

JP 08099265 A 4/1996

*Primary Examiner* — Eileen P Morgan

(74) *Attorney, Agent, or Firm* — Greer Burns & Crain Ltd.

(57) ABSTRACT

A polishing apparatus includes a polishing unit having a spindle having an axial bore defined therein, a housing by which the spindle is rotatably supported, a polishing pad mounted on an end of the spindle and having an opening defined therein that is held in fluid communication with the axial bore, a slurry supply pipe inserted in the axial bore in the spindle and having a supply port supplying a slurry to the workpiece held on the chuck table and an inlet port remote from the supply port, introducing the slurry into the slurry supply pipe, a slurry introducing unit connected to the inlet port of the slurry supply pipe, introducing the slurry into the inlet port, and a cleaning water introducing unit connected to the inlet port of the slurry supply pipe, introducing cleaning water into the inlet port.

3 Claims, 5 Drawing Sheets

(56) References Cited

U.S. PATENT DOCUMENTS

| | | | | |
|---|---|---|---|---|
| 11,135,612 | B2 * | 10/2021 | Henderson | B25J 11/0065 |
| 2004/0176017 | A1 * | 9/2004 | Zelenski | B24B 37/08 451/41 |

* cited by examiner

POLISHING APPARATUS

BACKGROUND OF THE INVENTION

Field of the Invention

The present invention relates to a polishing apparatus for polishing a workpiece while supplying a slurry to the workpiece.

Description of the Related Art

Wafers with a plurality of devices such as integrated circuits (ICs), large scale integration (LSI) devices, or the like formed on their face sides in respective areas demarcated by a grid of projected dicing lines have their reverse sides polished and finished to a desired level of roughness by a polishing apparatus. Then, such a polished wafer is divided into individual device chips by a dividing apparatus such as a laser processing apparatus, a dicing apparatus, or the like. The individual device chips thus divided will be used in electric appliances such as mobile phones, personal computers, and so on (see, for example, Japanese Patent Laid-Open No. Hei 08-099265).

FIGS. 4 and 5 of the accompanying drawings illustrate one conventional polishing apparatus 100. As illustrated in FIG. 4, the polishing apparatus 100 includes a rotatable chuck table 107 for holding a wafer W thereon, polishing means 103 having a rotatable polishing pad 105 for polishing the wafer W held on the chuck table 107, and polishing feed means 106 for moving the polishing means 103 selectively toward and away from the chuck table 107 to selectively press the polishing pad 105 against and release the polishing pad 105 from the wafer W held on the chuck table 107.

As illustrated in FIG. 5, the polishing means 103 includes a spindle 120 with the polishing pad 105 mounted on a lower end thereof, a housing 104 by which the spindle 120 is rotatably supported, and an actuator 110 having a rotor 110*a* disposed on an outer circumferential surface of the spindle 120 and a stator coil 110*b* disposed in the housing 104 in radially facing relation to an outer circumferential surface of the rotor 110*a*. The spindle 120 has an axial bore 120*a* defined therein that extends axially through the spindle 120. The polishing pad 105 has an opening 105*a* defined therein that is held in fluid communication with the axial bore 120*a* in the spindle 120. The axial bore 120*a* houses a slurry supply pipe 130 extending axially therein for supplying a muddy slurry S that contains loose abrasive grains to the wafer W held on the chuck table 107. The slurry supply pipe 130 is connected to a slurry supply system 150, and supplies the slurry S from its lower end to the wafer W held on the chuck table 107. The slurry supply system 150 includes a slurry storage tank 152, a discharge pump 154, a control valve 156, and a slurry supply conduit 158. While the spindle 120 is being rotated about its own axis in the direction indicated by an arrow R1 by the actuator 110 and the chuck table 107 is being rotated about its own axis in the direction indicated by an arrow R2, the slurry S is supplied from the slurry supply pipe 130 to the wafer W, so that the wafer W is polished by the polishing pad 105 to finish its reverse side to a desired level of roughness.

SUMMARY OF THE INVENTION

As illustrated in FIG. 5, the lower end of the slurry supply pipe 130 of the conventional polishing apparatus 100 should preferably extend downwardly closely to the opening 105*a* in the polishing pad 105 to prevent the inside of the spindle 120 from being contaminated by the slurry S. However, when the wafer W is polished by the polishing apparatus 100, since the chuck table 107 and the spindle 120 are rotated at high speeds, a slurry S' that contains abraded debris produced during the polishing process tends to be scattered onto an inner wall surface of the spindle 120 that defines the axial bore 120*a*. The slurry S' that contains abraded debris is attached to and gradually deposited on a certain region of the inner wall surface of the spindle 120 above the opening 105*a* in the polishing pad 105. The slurry S' deposited on the inner wall surface of the spindle 120 gradually grows and then falls off the inner wall surface of the spindle 120 due to vibrations during the polishing process. The falling slurry S' drops through the opening 105*a* in the polishing pad 105 onto the reverse side, which faces upwardly, of the wafer W and tends to enter between the polishing pad 105 and the wafer W. When the slurry S' that contains abraded debris enters between the polishing pad 105 and the wafer W, it presents an obstacle to the polishing process, and is likely to smear the polished surface of the wafer W.

It is therefore an object of the present invention to provide a polishing apparatus for polishing a surface of a workpiece while supplying the surface of the workpiece with a slurry from a slurry supply pipe disposed in a spindle, the polishing apparatus having means for preventing a slurry that contains abraded debris from dropping onto the surface, which faces upwardly, of the workpiece and hence from presenting an obstacle to a polishing process and from smearing the polished surface of the workpiece.

In accordance with an aspect of the present invention, there is provided a polishing apparatus including a chuck table holding a workpiece thereon and a polishing unit polishing the workpiece held on the chuck table. The polishing unit includes a spindle having an axial bore defined therein, a housing by which the spindle is rotatably supported, a polishing pad mounted on an end of the spindle and having an opening defined therein that is held in fluid communication with the axial bore, a slurry supply pipe inserted in the axial bore in the spindle and having a supply port supplying a slurry to the workpiece held on the chuck table and an inlet port remote from the supply port, introducing the slurry into the slurry supply pipe, slurry introducing means connected to the inlet port of the slurry supply pipe, introducing the slurry into the inlet port, and cleaning water introducing means connected to the inlet port of the slurry supply pipe, introducing cleaning water into the inlet port. The slurry supply pipe has an ejection port defined in a side wall of the slurry supply pipe above and near the supply port thereof, the ejection port being open toward an inner wall surface of the spindle that defines the axial bore. The slurry introducing means introduces the slurry into the slurry supply pipe at a flow rate set to such a value that the slurry introduced into the slurry supply pipe reaches the supply port without being ejected from the ejection port and is supplied from the supply port through the central opening in the polishing pad to the workpiece held on the chuck table. The cleaning water introducing means introduces the cleaning water into the slurry supply pipe at a flow rate set to such a value, which is larger than the flow rate of the slurry, that the cleaning water introduced into the slurry supply pipe is ejected from the ejection port toward the inner wall surface of the spindle and cleans the inner wall surface of the spindle.

Preferably, the supply port has a diameter smaller than an inside diameter of the slurry supply pipe leading to the supply port causing the cleaning water introduced into the slurry supply pipe to be ejected from the ejection port toward the inner wall surface of the spindle and cleans the inner wall surface of the spindle. Preferably, the slurry supply pipe has a guide disposed therein guiding the cleaning water toward the ejection port, whereby the cleaning water is ejected from the ejection port toward the inner wall surface of the spindle and cleans the inner wall surface of the spindle.

According to the present invention, even when a slurry containing abraded debris is deposited in an area on the inner wall surface of the spindle above the supply port, the cleaning water introduced into the slurry support pipe is ejected from the ejection port toward the inner wall surface of the spindle and removes the slurry from the inner wall surface of the spindle, thereby cleaning the inner wall surface of the spindle. The slurry containing abraded debris is thus prevented from dropping onto a workpiece to be polished and smearing a polished surface of the workpiece.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
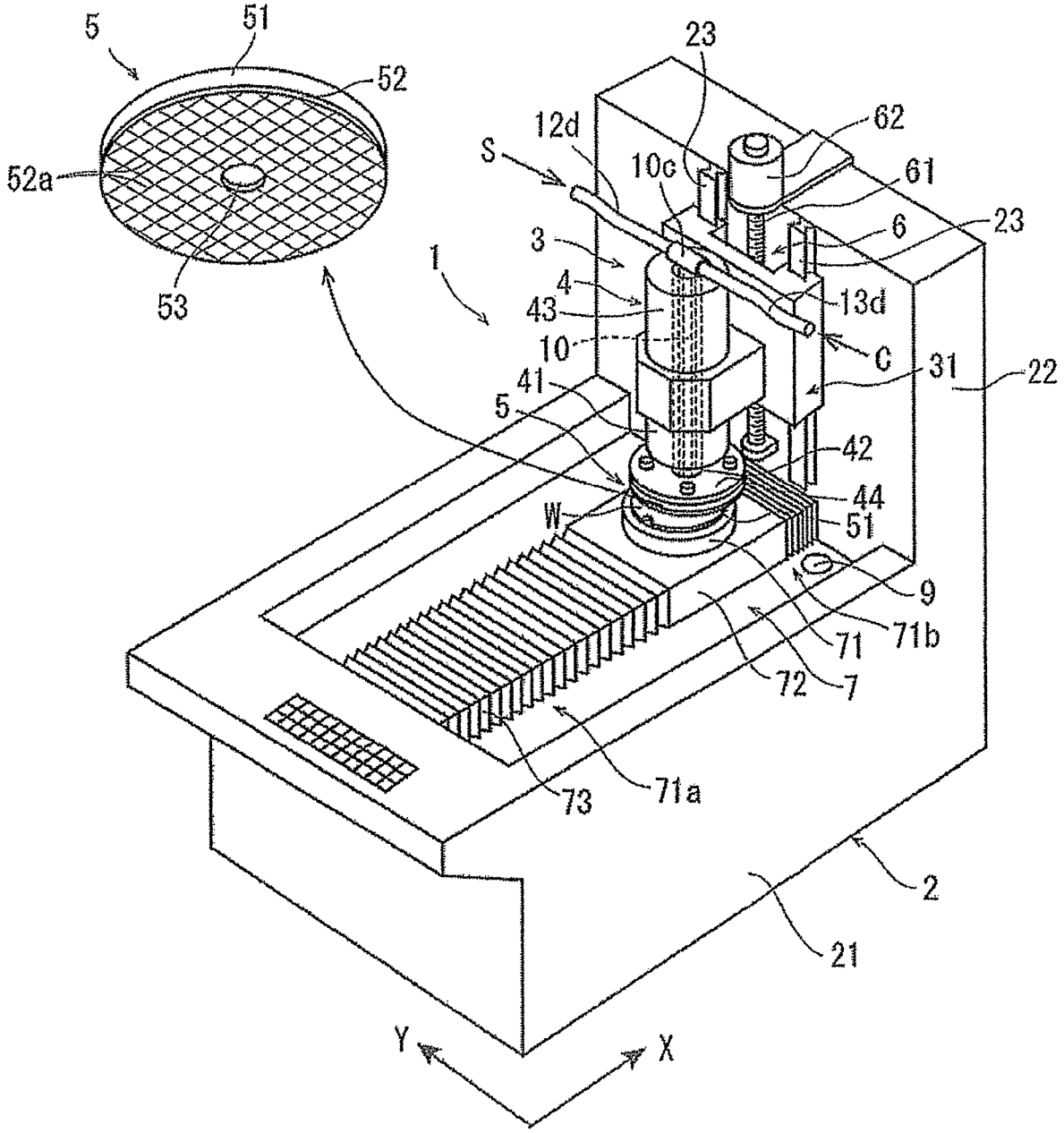
FIG. 1 is a perspective view of a polishing apparatus according to an embodiment of the present invention.

A polishing apparatus according to an embodiment of the present invention will be described in detail below with reference to the accompanying drawings. FIG. 1 illustrates in perspective a polishing apparatus, denoted by 1, according to the present embodiment. As illustrated in FIG. 1, the polishing apparatus 1 includes an apparatus housing 2. The apparatus housing 2 has a main body 21 substantially in the shape of a rectangular parallelepiped and an upstanding wall 22 extending upwardly from a rear end portion, depicted as a right end portion, of the main body 21. Polishing means (polishing unit) 3 that serves as processing means is vertically movably mounted on a front surface of the upstanding wall 22.

The polishing means 3 includes a movable base 31, a spindle unit 4 mounted on the movable base 31, and a polishing pad 5 mounted on the spindle unit 4. The movable base 31 is held in slidable engagement with a pair of guide rails 23 disposed on the front surface of the upstanding wall 22. The spindle unit 4 is mounted on a front surface of the movable base 31 by a support that protrudes forwardly from the movable base 31.

The spindle unit 4 includes a housing 41, a spindle 42 rotatably supported by the housing 41, and a servomotor 43 as an actuator for rotating the spindle 42 about its own axis. The spindle 42 has a lower end portion projecting downwardly from the lower end of the housing 41 and including a disk-shaped wheel mount 44. The polishing pad 5 is attached to the lower surface of the wheel mount 44.

The polishing pad 5 with its lower surface being visible is illustrated in the upper left inset in FIG. 1. The polishing pad 5 includes a base 51 fastened to the wheel mount 44 by bolts and a polishing sheet 52 disposed on the lower surface of the base 51. The base 51 is of a disk shape similar to the wheel mount 44, and may be made of aluminum alloy, for example. The polishing sheet 52, which may include a foamed urethane sheet, is bonded to the lower surface of the base 51 by adhesive means such as a double-faced adhesive tape or the like. The polishing sheet 52 has a grid of narrow grooves 52*a* defined in its lower surface for allowing a slurry S supplied during a polishing process to spread all over the lower surface of the polishing sheet 52. The polishing sheet 52 has a central opening 53 defined in the base 51 and the polishing sheet 52. The slurry S is supplied through the central opening 53 to a workpiece from a slurry supply pipe 10, to be described later, disposed in the spindle 42. The polishing sheet 52 can be peeled off from the base 51 after having been used for a predetermined period of time and replaced with a new polishing sheet 52.

The polishing apparatus 1 includes a polishing means feeding mechanism 6 for moving the polishing means 3 along the guide rails 23 in vertical directions, i.e., directions perpendicular to the holding surface of a chuck table to be described below. The polishing means feeding mechanism 6 includes an externally threaded rod 61 disposed over the front surface of the upstanding wall 22 and extending substantially vertically, a stepping motor 62 serving as an actuator coupled to the upper end of the externally threaded rod 61, for rotating the externally threaded rod 61 about its own axis, and a bearing such as a ball nut or the like, not depicted, mounted on a rear surface of the movable base 31 and threaded over the externally threaded rod 61. When the stepping motor 62 is energized to rotate its output shaft in a normal direction, the externally threaded rod 61 rotates in one direction to lower the polishing means 3. When the stepping motor 62 is energized to rotate its output shaft in a reverse direction, the externally threaded rod 61 rotates in the other direction to lift the polishing means 3.

The main body 21 of the apparatus housing 2 houses therein a chuck table mechanism 7 serving as holding means for holding a wafer W as the workpiece. The chuck table mechanism 7 includes a chuck table 71 for holding the wafer W under suction thereon, a cover 72 covering a region around the chuck table 71, and bellows means 73 disposed forwardly and rearwardly of the cover 72. The chuck table 71 is connected to suction means, not depicted, that generates a suction force to attract the wafer W to the chuck table 71. The main body 21 has a collection hole 9 defined in its upper wall near the bellows means 73 for collecting a slurry S' containing abraded debris discharged after the slurry S supplied to the wafer W on the chuck table 71 has been used in the polishing process and also for collecting cleaning water C to be described later.

The chuck table 71 is rotatable about its own vertical axis by a rotary actuator, not depicted, and is also linearly movable in X-axis directions indicated by an arrow X by chuck table moving means, not depicted, between a workpiece loading area 71*a* and a polishing area 71*b* where the polishing process is carried out on the wafer W by the polishing pad 5.

Figure 2:
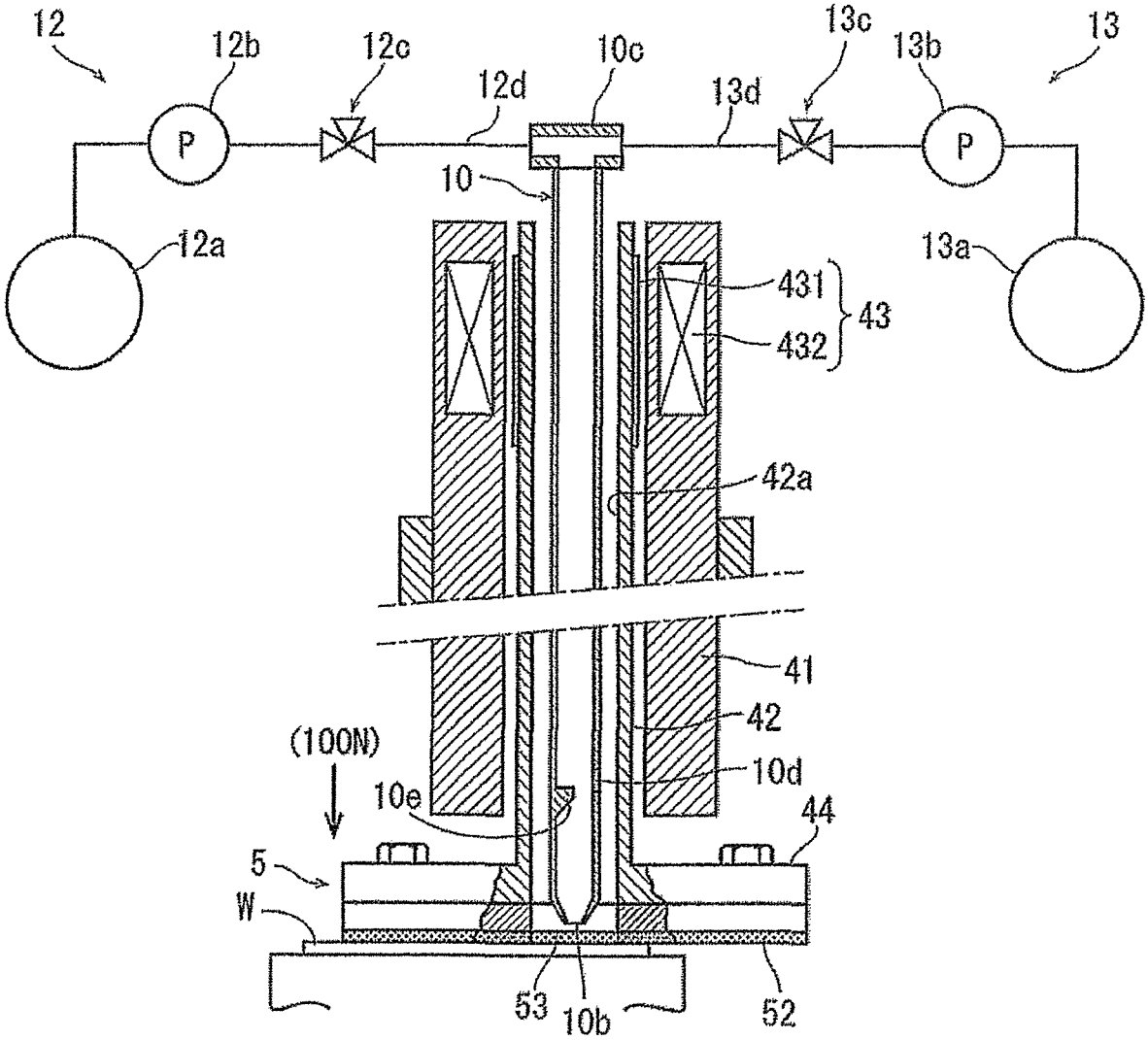
FIG. 2 is a cross-sectional view, partly at an enlarged scale, of a spindle unit incorporated in the polishing apparatus illustrated in FIG. 1.

FIG. 2 is a cross-sectional view, partly at an enlarged scale, of the spindle unit 4 with its middle portion omitted from illustration. As illustrated in FIG. 2, the servomotor 43 includes at least a rotor 431 disposed on an outer circumferential surface of the spindle 42 and a stator coil 432 disposed in the housing 41 in radially facing relation to an outer circumferential surface of the rotor 431. The stator coil 432 is connected to a high-frequency power supply, not depicted, that supplies a predetermined amount of electric power to the servomotor 43. The spindle 42 has an axial bore 42*a* defined therein that extends axially through the spindle 42 and held in fluid communication with the central opening 53 in the polishing pad 5. The slurry supply pipe 10 is axially inserted in the axial bore 42*a*. An air bearing, not depicted, by which the spindle 42 is held in thrust and radial directions with high-pressure air is disposed around the spindle 42. When the spindle 42 is rotated about its own axis, the spindle 42 is held out of contact with the housing 41 by the air bearing. Therefore, any resistance to the rotation of the spindle 42 is held to a minimum when the spindle 42 is rotated at high speeds.

The slurry supply pipe 10 is fixed to the movable base 31 by fixing means, not depicted, and held in position independently of the spindle 42. The slurry supply pipe 10 has a supply port 10*b* defined in its lower end for supplying the slurry S or cleaning water C to the wafer W on the chuck table 71, an inlet port 10*c* defined in its upper end for introducing the slurry S or cleaning water C into the slurry supply pipe 10, an ejection port 10*d* defined in a side wall of the slurry supply pipe 10 at an intermediate position above and near the supply port 10*b* and being open out of the slurry supply pipe 10, and a guide body 10*e* projecting radially inwardly from an inner wall surface of the slurry supply pipe 10 in diametrically facing relation to the ejection port 10*d* at substantially the same height as the ejection port 10*d*, for deflecting and guiding the cleaning water C toward the ejection port 10*d*.

The inlet port 10*c* is connected to slurry introducing means 12 that introduces the slurry S into the inlet port 10*c* and cleaning water introducing means 13 that introduces the cleaning water C into the inlet port 10*c*. The slurry introducing means 12 includes a slurry storage tank 12*a* for storing the slurry S, a slurry pressure-delivery pump 12*b* for drawing the slurry S from the slurry storage tank 12*a* and discharging the slurry S, a slurry control valve 12*c* for controlling the introduction of the slurry S from the slurry pressure-delivery pump 12*b* into the inlet port 10*c*, and a slurry introduction conduit 12*d* interconnecting the slurry storage tank 12*a*, the slurry pressure-delivery pump 12*b*, the slurry control valve 12*c*, and the inlet port 10*c*, for introducing the slurry S into the inlet port 10*c*. The cleaning water introducing means 13 includes a cleaning water storage tank 13*a* for storing the cleaning water C, a cleaning water pressure-delivery pump 13*b* for drawing the cleaning water C from the cleaning water storage tank 13*a* and discharging the cleaning water C, a cleaning water control valve 13*c* for controlling the introduction of the cleaning water C from the cleaning water pressure-delivery pump 13*b* into the inlet port 10*c*, and a cleaning water introduction conduit 13*d* interconnecting the cleaning water storage tank 13*a*, the cleaning water pressure-delivery pump 13*b*, the cleaning water control valve 13*c*, and the inlet port 10*c*, for introducing the cleaning water C into the inlet port 10*c*. In FIG. 1, the components of the slurry introducing means 12 and the cleaning water introducing means 13 except for the slurry introduction conduit 12*d* and the cleaning water introduction conduit 13*d* are omitted from illustration.

The slurry S is introduced into the slurry supply pipe 10 by the slurry introducing means 12 at a flow rate Sf that is set to such a small value of 0.1 L/min, for example, that the slurry S flows down the inner wall surface of the slurry supply pipe 10 due to its surface tension to the supply port 10*b* without overflowing through the ejection port 10*d* in the side wall of the slurry supply pipe 10, and then is supplied through the opening 53 in the polishing pad 5 to the wafer W on the chuck table 71. The cleaning water C is introduced into the slurry supply pipe 10 by the cleaning water introducing means 13 at a flow rate Cf set to such a value ranging from 0.5 to 10 L/min, which is larger than the flow rate Sf of the slurry S, that the slurry S introduced into the slurry supply pipe 10 overflows through the ejection port 10*d* and is ejected toward the inner wall surface of the spindle 42, which defines the axial bore 42*a*, thereby cleaning the inner wall surface of the spindle 42. According to the present embodiment, the supply port 10*b* defined in the lower end of the slurry supply pipe 10 is of a constricted shape and has a diameter smaller than the inside diameter of the slurry supply pipe 10 leading to and above the supply port 10*b*.

The polishing apparatus 1 according to the present embodiment is generally constructed as described above. Operation of the polishing apparatus 1 will be described below with reference to FIGS. 1, 2, 3A, and 3B. The operator of the polishing apparatus 1, who manages a polishing process to be carried out by the polishing apparatus 1, applies a protective tape, not depicted, to the face side of the wafer W on which devices are formed, and places the wafer W, with the face side facing downwardly, onto the chuck table 71 that has been moved to the workpiece loading area 71*a* depicted in FIG. 1. Then, the operator actuates the suction means, not depicted, connected to the chuck table 71 to hold the wafer W under suction on the chuck table 71.

Then, the operator actuates the chuck table moving means to move the chuck table 71 from the workpiece loading area 71*a* to the polishing area 71*b* where the wafer W held under suction on the chuck table 71 is positioned directly below the polishing pad 5, with the center of the polishing pad 5 being out of alignment with the center of the chuck table 71 as viewed in plan.

Figure 3A:
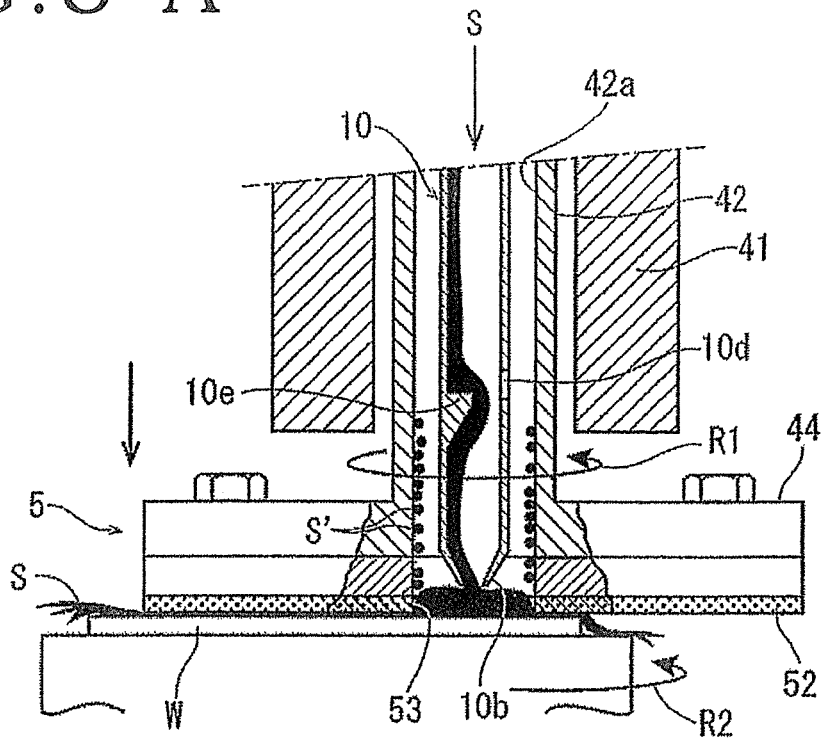
FIGS. 3A and 3B are fragmentary cross-sectional views, partly at an enlarged scale, of the spindle unit, illustrating the manner in which the polishing apparatus illustrated in FIG. 1 operates.

After the chuck table 71 has been positioned directly below the polishing pad 5, the polishing pad 5 is lowered to press the entire reverse side of the wafer W under a force of 100 N, for example, as illustrated in FIG. 2. The slurry pressure-delivery pump 12*b* of the slurry introducing means 12 is actuated, and the slurry control valve 12*c* is opened. The slurry S supplied from the slurry storage tank 12*a* is now introduced into the slurry supply pipe 10, as illustrated in FIG. 3A. At this time, as described above, the slurry S is introduced into the slurry supply pipe 10 at a flow rate Sf that is set to such a small value of 0.1 L/min, for example, that the slurry S flows down the inner wall surface of the slurry supply pipe 10 without overflowing through the ejection port 10*d* in the side wall of the slurry supply pipe 10. While the slurry S is being supplied from the slurry supply pipe 10 through the constricted supply port 10*b* to the boundary between the polishing sheet 52 and the wafer W, the polishing pad 5 is rotated at a rotational speed of 6000 rpm in the direction indicated by an arrow R1, for example, and at the same time the chuck table 71 is rotated by the rotary actuator at a rotational speed of 300 rpm in the direction indicated by an arrow R2, for example, thereby polishing the reverse side of the wafer W. At this time, the cleaning water introducing means 13 is not in operation. When the polishing of the wafer W is completed, the slurry pressure-delivery pump 12*b* of the slurry introducing means 12 is shut off, and the slurry control valve 12*c* is closed. The polished wafer W is delivered to a next step such as a cleaning step or the like. Although not illustrated in FIG. 1, the polishing apparatus 1 may include a cassette table for placing thereon a cassette that houses therein wafers W that are to be processed and wafers W that have been processed, cleaning means for cleaning wafers W that have been processed, and delivery means for delivering wafers W between the cassette and the cleaning means.

While the above polishing process is being repeated, a slurry S' containing abraded debris is scattered and deposited in an area, also referred to as a slurry-deposited area, on a lower end portion of the inner wall surface of the spindle 42 as shown in FIG. 3A. As the slurry S' is repeatedly deposited, it gradually grows the inner wall surface of the spindle 42 and then falls off the inner wall surface of the spindle 42 due to vibrations during the polishing process. The slurry S' that has dropped tends to present an obstacle to subsequent polishing processes. Therefore, the operator carries out a cleaning process for removing the slurry S' at suitable timings. The cleaning process will be described below with reference to FIGS. 2 and 3B.

Figure 3B:
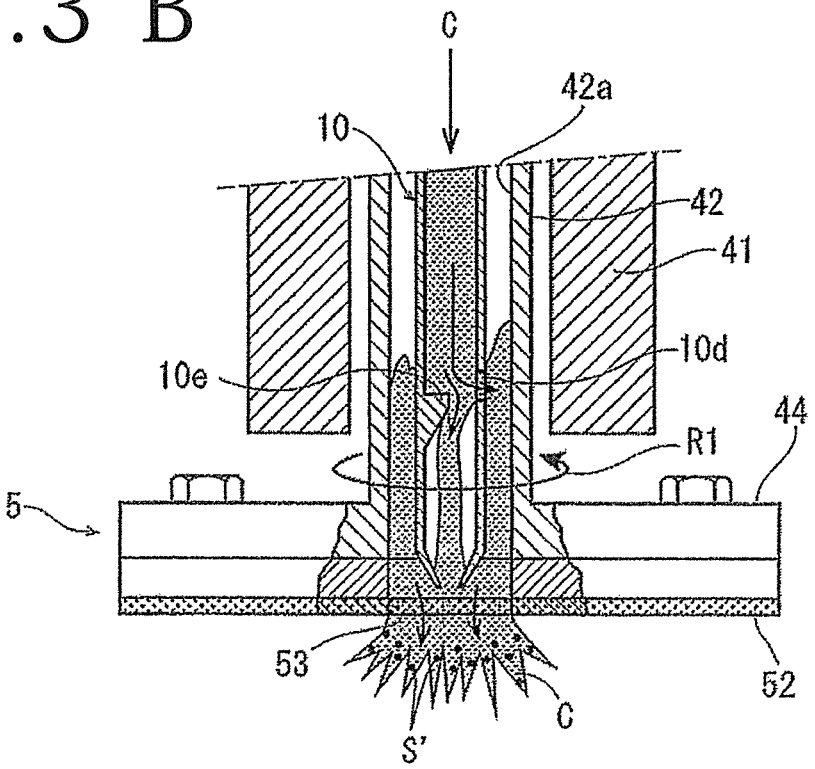
Figure 4:
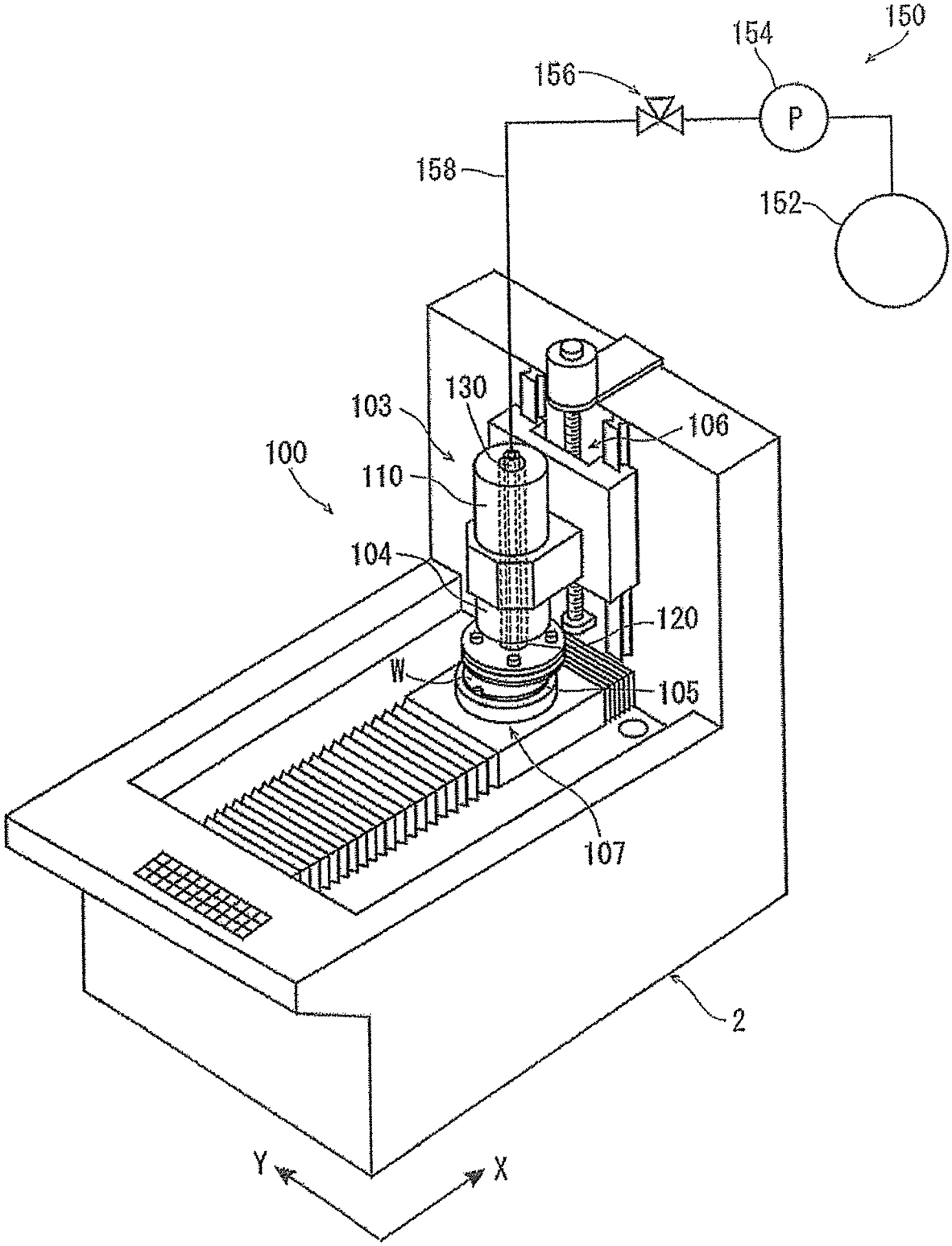
FIG. 4 PRIOR ART
FIG. 4 is a perspective view of a conventional polishing apparatus.
Figure 5:
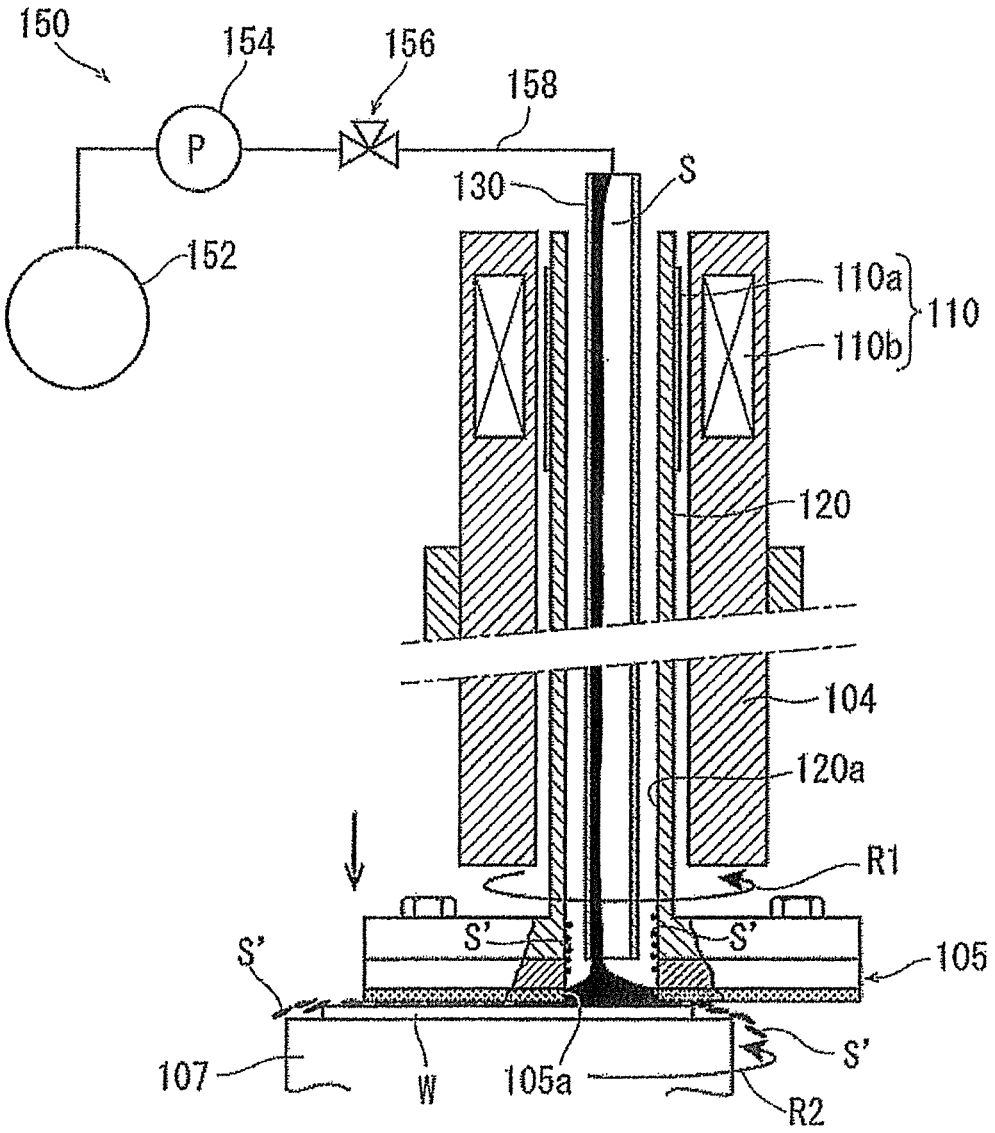
FIG. 5 PRIOR ART
FIG. 5 is a cross-sectional view, partly at an enlarged scale, of a spindle unit incorporated in the conventional polishing apparatus illustrated in FIG. 4.

During the cleaning process, no polishing process is carried out. Therefore, the slurry pressure-delivery pump 12*b* of the slurry introducing means 12 is shut off, and the slurry control valve 12*c* is closed in the cleaning process. Prior to the start of the cleaning process, the polishing means 3 is lifted together with the movable base 31, and the chuck table 71 is moved to the workpiece loading area 71*a*. Then, the cleaning water introducing means 13 is actuated. Specifically, the cleaning water pressure-delivery pump 13*b* is activated, and the cleaning water control valve 13*c* is opened. The servomotor 43 is energized to rotate the spindle 42 at a rotational speed of 6000 rpm in the direction indicated by the arrow R1. When the cleaning water introducing means 13 is actuated and the servomotor 43 is energized, the cleaning water C supplied from the cleaning water storage tank 13*a* is forcibly introduced into the slurry supply pipe 10, as illustrated in FIG. 3B. As described above, the cleaning water C is introduced into the slurry supply pipe 10 at a flow rate Cf that is set to such a value ranging from 0.5 to 1.0 L/min, for example, that the cleaning water C flows down the slurry supply pipe 10 to the position of the guide body 10*e* disposed on the inner wall surface of the slurry supply pipe 10 in diametrically facing relation to the ejection port 10*d*. In the position of the guide body 10*e*, the flow channel in the slurry supply pipe 10 is restricted by the guide body 10*e*. Consequently, the cleaning water C flowing down the slurry supply pipe 10 is deflected and guided toward the ejection port 10*d*, from which the cleaning water C is ejected into the axial bore 42*a* in the spindle 42.

The ejection port 10*d* is positioned at the intermediate position above and near the supply port 10*b*, i.e., above and near a position diametrically opposite the slurry-deposited area on the lower end portion of the inner wall surface of the spindle 42. When the cleaning water C is ejected from the ejection port 10*d* into the axial bore 42*a* in the spindle 42, the spindle 42 is being rotated at the predetermined rotational speed. Therefore, the cleaning water C is forcibly supplied fully circumferentially to the inner wall surface of the spindle 42 on which the slurry S' containing abraded debris is deposited, thereby washing down the deposited slurry S', which is discharged together with the cleaning water C from the opening 53 in the polishing pad 5. In this manner, the axial bore 42*a* in the spindle 42 is cleaned for a predetermined cleaning time. Thereafter, the spindle 42 stops being rotated and the cleaning water introducing means 13 is shut off. Subsequently to the cleaning process, a new polishing process can be carried out on another wafer W without the possibility that a slurry S' containing abraded debris will drop onto the wafer W.

The present invention is not limited to the above illustrated embodiment. Rather, various changes and modifications may be covered by the invention. In the above embodiment, the guide body 10*e* is disposed in the vicinity of the ejection port 10*d* of the slurry supply pipe 10 and the supply port 10*b* is constricted and has a diameter smaller than the inside diameter of the slurry supply pipe 10 leading to and above the supply port 10*b* in order to eject the cleaning water C efficiently from the ejection port 10*d*. However, it is not necessary for the slurry supply pipe 10 to have both the guide body 10*e* and the constricted supply port 10*b*. Rather, the slurry supply pipe 10 may have either the constricted supply port 10*b* to cause the cleaning water C to overflow through the ejection port 10*d* or the guide body 10*e* to guide the cleaning water C toward the ejection port 10*d*. The guide body 10*e* is not limited to any particular shape, but may be of any shape insofar as it prevents the cleaning water C introduced into the slurry supply pipe 10 from flowing directly to the supply port 10*b* and guides the cleaning water C toward the ejection port 10*d*.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A polishing apparatus comprising:

a chuck table holding a workpiece thereon; and a polishing unit polishing the workpiece held on the chuck table, wherein the polishing unit includes a spindle having an axial bore defined therein, a housing by which the spindle is rotatably supported, a polishing pad mounted on an end of the spindle and having an opening defined therein that is held in fluid communication with the axial bore, a slurry supply pipe inserted in the axial bore in the spindle and having a supply port supplying a slurry to the workpiece held on the chuck table and an inlet port remote from the supply port, introducing the slurry into the slurry supply pipe, slurry introducing means connected to the inlet port of the slurry supply pipe, introducing the slurry into the inlet port, and cleaning water introducing means connected to the inlet port of the slurry supply pipe, introducing cleaning water into the inlet port, the slurry supply pipe has an ejection port defined in a side wall of the slurry supply pipe above and near the supply port thereof, the ejection port being open toward an inner wall surface of the spindle that defines the axial bore, the slurry introducing means introduces the slurry into the slurry supply pipe at a flow rate set to such a value that the slurry introduced into the slurry supply pipe reaches the supply port without being ejected from the ejection port and is supplied from the supply port through the central opening in the polishing pad to the workpiece held on the chuck table, and the cleaning water introducing means introduces the cleaning water into the slurry supply pipe at a flow rate set to such a value, which is larger than the flow rate of the slurry, that the cleaning water introduced into the slurry supply pipe is ejected from the ejection port toward the inner wall surface of the spindle and cleans the inner wall surface of the spindle.

2. The polishing apparatus according to claim 1, wherein the supply port has a diameter smaller than an inside diameter of the slurry supply pipe leading to the supply port causing the cleaning water introduced into the slurry supply pipe to be ejected from the ejection port toward the inner wall surface of the spindle and cleans the inner wall surface of the spindle.

3. The polishing apparatus according to claim 1, wherein the slurry supply pipe has a guide disposed therein guiding the cleaning water toward the ejection port, whereby the cleaning water is ejected from the ejection port toward the inner wall surface of the spindle and cleans the inner wall surface of the spindle.

* * * * *